US005779819A

United States Patent [19]

Huppi

[11] Patent Number: 5,779,819

[45] Date of Patent: Jul. 14, 1998

[54] GRAIN ORIENTED ELECTRICAL STEEL HAVING HIGH VOLUME RESISTIVITY

[75] Inventor: Glenn Stuart Huppi, Monroe, Ohio

[73] Assignee: Armco Inc., Middletown, Ohio

[21] Appl. No.: 803,486

[22] Filed: Feb. 20, 1997

Related U.S. Application Data

[62] Division of Ser. No. 442,459, May 16, 1995, Pat. No. 5,643,370.

[51] Int. Cl.[6] ..... H01F 1/147

[52] U.S. Cl. ..... 148/308; 420/117

[58] Field of Search ..... 148/307, 308; 420/117

[56] References Cited

U.S. PATENT DOCUMENTS

| | | | |
|---|---|---|---|
| 3,892,605 | 7/1975 | Thornburg | 148/308 |
| 4,293,336 | 10/1981 | Matsumura et al. | 420/117 |
| 4,483,723 | 11/1984 | Lyudkovsky | 148/307 |
| 4,596,614 | 6/1986 | Marder et al. | 148/111 |
| 4,979,996 | 12/1990 | Kobayashi et al. | 148/111 |
| 5,250,123 | 10/1993 | Yashiki et al. | 148/111 |
| 5,318,639 | 6/1994 | Hayakawa et al. | 148/113 |
| 5,346,559 | 9/1994 | Ushigami et al. | 148/111 |
| 5,425,820 | 6/1995 | Yashiki et al. | 148/307 |

OTHER PUBLICATIONS

Kawasaki Seitetsu Giho, vol. 21, No. 3, pp. 93–98, 1989, "Developments of Grain Oriented Si Steel Sheets with Low Iron Loss" Sadayori et al.

*Primary Examiner*—John Sheehan

*Attorney, Agent, or Firm*—R. J. Bunyard; L. A. Fillnow

[57] ABSTRACT

The present invention relates to the production of a grain oriented electrical steel composition having a volume resistivity of at least 50 micro-ohm-cm. The melt composition of the steel consists essentially of, in weight %, about 0.08% max carbon, about 0.015 to about 0.05% aluminum, about 2.25 to 7% silicon, greater than about 0.5% $manganese_{eq}$, about 0.001 to about 0.011% nitrogen, about 0.01% max sulfur, about 3% max chromium, about 1% max copper, about 2% max nickel and balance essentially iron. High levels of silicon are balanced with a manganese equivalent relationship which permits lower levels of carbon while still providing the desired levels of austenite during rolling and annealing. The processing also includes the addition of excess nitrogen to the steel prior to secondary grain growth which is subsequently removed during a purification treatment.

8 Claims, 2 Drawing Sheets

GRAIN ORIENTED ELECTRICAL STEEL HAVING HIGH VOLUME RESISTIVITY

This application is a division of U.S. Ser. No. 08/442,459; filed May 16, 1995, now U.S. Pat. No. 5,643,370 incorporated herein by reference.

BACKGROUND OF THE INVENTION

The manufacture of grain oriented electrical steels requires critical control of chemistry and processing to achieve the desired magnetic properties in a stable and reproducible manner. The present invention produces excellent magnetic properties in (110)[001] oriented electrical steel having a high volume resistivity.

The specific magnetic property used to evaluate the quality of oriented electrical steel varies with the device manufactured from the steel. However, the highest quality usually implies the lowest core loss at an alternating magnetic field of a specified frequency and amplitude, for example: 60 hertz, 1.5 Teslas. The core loss may be lowered by one or more of the following methods: 1) increasing the volume resistivity through the addition of solute elements (principally silicon); 2) improving the degree of (110)[001] orientation through alloy and process modifications; 3) reducing the final thickness of the steel; 4) improving the purity of the alloy by raw material selection and/or process modifications; 5) improving the magnetic domain structure by one or more process modifications: increasing secondary grain boundary area (reduced secondary grain size and/or increased grain boundary roughness); using a scribing technique; and applying a stress inducing coating.

In recent years, core loss improvements have been made to grain oriented electrical steels which increased the volume resistivity from 47–49 micro-ohm-cm (μ-Ω-cm) to 50–51 micro-ohm-cm. This increase in volume resistivity was obtained by raising the silicon content of the steel from a level of 2.9–3.15 wt % to a level of 3.25–3.5 wt %. This small increase in silicon required intensive development efforts; adjustments were required to alloying elements other than Si; modifications were necessary for process anneals and rolling procedures; and material handling methods had to be improved to accommodate an increased tendency for strip breakage. The practical limit for silicon in a grain oriented steel used in power and power distribution transformers is thought to be 4.5 wt % where the volume resistivity of iron-silicon alloys reaches a level of 63 micro-ohm-cm. Above 4.5 wt % silicon, the loss of ductility requires costly modifications to the cold rolling and handling procedures associated with the manufacture of grain oriented electrical steel.

A high degree of (110)[001] orientation is achieved in grain oriented electrical steels by processing to obtain selective secondary grain growth which is vigorous enough to consume virtually all grains deviating from the (110)[001] orientation. For secondary grain growth to be both selective and vigorous, a material must have a structure of recrystallized grains with a controlled distribution of orientations, and must have a grain growth inhibitor to restrain primary grain growth in the final anneal until secondary grain growth occurs, typically in the temperature range of 760°–1050° C. (1400°–1922° F.). The production of grain oriented electrical steel relies on the use of precipitates, such as MnS, Mn(S,Se), AlN or combinations of these to act as grain growth inhibitors and may also use minor additions of elements, such as Sb, Cu, Sn and others, which may modify the behavior of the precipitates and/or control the distribution of grain orientations prior to secondary grain growth. The size and spatial distribution of primary grain growth inhibitor precipitates suitable for grain oriented electrical steels has traditionally been provided by a slab or ingot solution treatment immediately prior to hot rolling. The primary grain growth inhibitor precipitates are then formed during the hot rolling operation and/or during subsequent heat treatments.

The traditional processing of oriented electrical steels includes reheating a cooled slab or ingot to temperatures in excess of 1300° C. (2370° F.) prior to hot rolling to a thickness normally less than 3 mm. This high temperature reheating practice allows the MnS, Mn(S,Se) and/or AlN to be dissolved prior to precipitation in a controlled manner during hot rolling and other subsequent processing. However, the high temperature reheating operation is costly, both from the aspect of its destructive effect on equipment and the loss of silicon steel due to the excessive oxidation of the slab or ingot surfaces. Efforts to reduce product loss and protect equipment have included the development of specialized heating equipment. The steel is heated to >1300° C. (2370° F.) in a non-oxidizing atmosphere or the interior of the ingot or slab is heated by induction heating to >1300° C. (2370° F.) while maintaining the surface below 1300° C. (2370° F.). Modified alloy compositions and processes for those alloys have also been developed which allow the use of reheat temperatures below 1300° C. The modified alloys and processes are referred to as "low reheat technologies."

Most of the low reheat technologies include the use of AlN precipitates, either with or without MnS precipitates, as the principle agent for inhibiting primary grain growth in slabs which are hot rolled from a temperature of 1100°–1250° C. A notable exception is the practice taught in U.S. Pat. No. 3,986,902 where a conventional grain oriented product is produced using a grain growth inhibitor consisting only of MnS precipitates. U.S. Pat. No. 3,986,902 teaches the use of a reduced product of manganese and sulfur, (%Mn)(%S), combined with a lower total oxygen in order to successfully produce oriented electrical steel from slabs or ingots hot rolled from temperatures of 1250° to 1300° C.

A majority of the grain oriented electrical steel technologies use an initial alloy composition which displays transcritical behavior. The alloy solidifies as ferrite (bcc iron), then, on cooling, becomes a mixture of ferrite and austenite (fcc iron), and on further cooling to <700° C., the austenite decomposes and the alloy becomes essentially ferrite again. Most of the traditional and low reheat technologies use carbon as a temporary alloying agent in Fe—Si alloys containing 2.8 to 3.5% Si such that the alloys exhibit transcritical behavior during hot rolling and/or process anneals and then become fully ferritic when carbon, the temporary alloying agent, is removed in a strip decarburization treatment. The alloys typically reach a peak austenite volume fraction between 0.05 and 0.50 at a temperature between 1100° and 1200° C. Alloys which are fully ferritic prior to the secondary grain growth anneal can be designed and processed such that the secondary growth will occur at temperatures in the range 700°–1100° C.

Alloys which retain transcritical behavior through all manufacturing operations must undergo complete secondary growth at temperatures below 950° C. or formation of austenite (fcc iron) will interfere with the growth of the secondary grains. This temperature range is below that normally associated with secondary grain growth that produces the highest degree of (110)[001] grain orientation. As such, these alloys are believed to have less potential as a displacive technology for the more traditional grain oriented electrical steels. This low secondary growth temperature range also excludes the use of these alloys for the production of a cube texture with a (100)[001] or (100)[hkl] orientation by a secondary growth method; the onset of secondary growth for cubic texture normally occurs above 1000° C. Examples of low reheat technologies which retain transcritical behavior after carbon removal include Fe—Si alloys containing <2% Si (U.S. Pat. No. 4,596,614) or Fe—Si—Mn alloys containing (Si −0.5Mn) <2% (U.S. Pat. No. 5,250,123).

A feature of the low reheat technologies using AlN precipitates as a grain growth inhibitor is the stated or inferred use of a nitriding treatment prior to secondary grain growth. Several technologies actually specify nitrogen levels that must be reached in the steel prior to secondary growth. All of these technologies teach the use of an atmosphere containing nitrogen or a separator coating which includes a nitrogen bearing compound in the secondary growth anneal during heating and secondary growth.

There are several low reheat technology patents which disclose a continuous strip nitriding treatment which may be used during or after decarburization to provide excellent magnetic properties in alloys using AlN and (Al,Si)N precipitates as the grain growth inhibitor. U.S. Pat. No. 4,979,996 had an electrical steel composition containing 0.025–0.075% C, 2.5–4.5% Si, 0.012% max S, 0.01–0.06% Al, 0.01% max N, 0.08–0.45% Mn, 0.015–0.045% P and balance essentially Fe. This patent disclosed the use of a continuous furnace to nitride the strip after the decarburizing anneal. For nitriding, the strip was held in the temperature range of 800°–850° C., in an atmosphere containing $NH_3$ and hydrogen for a time of at least 10 seconds and preferably less than 60 seconds. After the strip nitriding process was completed, at least 180 ppm nitrogen was present as averaged through the thickness of the steel. Long times were previously required for nitriding in order to diffuse the nitrogen between the laps of the tightly wound coils. Attempts were also made to nitride in loose coils but these were found to have uneven temperature distributions which caused uneven nitriding conditions.

In traditional grain oriented electrical steels, Mn is combined with S or S+Se to form MnS or Mn(S,Se) precipitates which function as all of, or a significant portion of, the grain growth inhibitor. Manganese is held to levels below 0.15% so that the product of (%Mn)(%S) or (%Mn)(%S+a%Se), where a is an empirically determined constant, is sufficiently low that the inhibitor precipitates may be dissolved entirely in the slabs or ingots prior to hot rolling. Most low reheat technologies rely completely or substantially on AlN precipitates as the grain growth inhibitor. Manganese is controlled to levels below 0.45% and typically less than 0.15%. Other additions may be made which modify the behavior of these precipitates and these include, by way of example, copper, antimony, arsenic, bismuth, tin, nickel and others.

An example of a low reheat technology which uses high manganese is U.S. Pat. No. 5,250,123. This patent discloses the use of a balance of Mn and Si such that (%Si)−0.5(%Mn) <2.0, which causes the claimed alloys to be transcritical without the use of carbon as a temporary alloying element. The steels of this patent had 1.5–3% silicon, 1–3% manganese, 0.002% maximum total for carbon and nitrogen, and 0.003–0.015% soluble aluminum in a grain oriented electrical steel. The soluble aluminum had to be maintained below 0.015% to avoid excessive inhibitors which were poorly dispersed. Silicon above 3% was stated to cause unstable secondary recrystallization and poor workability. The sum of carbon plus nitrogen above 0.002% after a final purification anneal was stated to form carbides and nitrides which obstructed domain wall movement and increased core loss. Manganese above 3% was stated to cause unstable secondary recrystallization and poor workability.

Grain oriented silicon steel has been balanced using compositions which restrict the levels of Si, C, Mn and Al in order to provide a material which is transcritical and may be processed with low slab reheat technology. A product has not been developed which allows high levels of Mn and Si in a transcritical material which has stable secondary grain growth, good workability and high volume resistivity.

SUMMARY OF THE INVENTION

The present invention provides a composition and method for producing grain oriented electrical steel having a high volume resistivity, preferably at least 55 micro-ohm-cm. The melt composition of the steel typically consists essentially of, in weight %, about 0.01 to 0.08% carbon, greater than 0.015% to about 0.05% aluminum, at least 2.75% silicon, greater than about 0.5% manganese, about 0.001 to about 0.011% nitrogen, about 0.01% max sulfur, about 3% max chromium, about 1% max copper, about 2% max nickel, about 0.1% max tin, and balance essentially iron. The level of silicon is balanced with a manganese equivalent relationship to permit the adjustment of carbon while still providing the desired levels of austenite during rolling and annealing. Low slab reheating temperatures may be used in the process. The processing also includes the use of a nitriding treatment prior to the completion of secondary grain growth and a purifying treatment to remove the nitrogen.

It is an object of the present invention to provide a grain oriented electrical steel with excellent magnetic properties using a composition balanced to provide a high volume resistivity of at least 50 micro-ohm-cm.

It is another object of the present invention to nitride a grain oriented electrical steel which has been decarburized to provide excellent magnetic properties after purification.

It is also an object of the present invention to produce grain oriented electrical steel, which at a thickness of 0.26 mm, has a core loss which is at least as good as 0.88 W/kg at 1.5 T and 60 Hz without requiring high slab reheat temperatures, diffusion alloying or scribing techniques for magnetic domain refinement.

It is a still further object to provide an electrical steel composition and method for producing orientations which are cube-on-edge (110)[001], cube-on-face (100)[001], "Equa Perm" (100)[hkl], or other orientations in a high resistivity electrical steel produced by a secondary growth process which does not use MnS as the primary grain growth inhibitor.

It is also an object of the present invention to produce a high volume resistivity grain oriented electrical steel which uses carbon as a temporary alloying agent to control transcritical allotropic behavior prior to decarburization of a base substitutional solid solution alloy that is substantially ferritic after decarburization in a strip decarburizing treatment.

It is a feature of the present invention to provide stable secondary grain growth in a grain oriented electrical steel having aluminum levels above 0.015% when using a nitriding and purification process.

It is another feature of the present invention to use carbon additions in the melt stage to control the amount of austenite present during processing and subsequently remove the carbon during the decarburizing anneal.

It is a still further feature of present invention to use silicon balanced with a manganese equivalent to provide an excellent combination of magnetic properties and a volume resistivity of at least 50 micro-ohm-cm.

It is an advantage of the present invention that diffusion alloying of substitutional solutes is not required for high volume resistivity.

It is a further advantage of the present invention that grain oriented electrical steel having high volume resistivity may be produced with slab reheat temperatures below 1300° C.

It is a still further advantage of the present invention that volume resistivity increases of at least 5 micro-ohm-cm may be produced without the need for increasing the level of silicon beyond 3.5 weight %.

It is also an advantage of the present invention that grain oriented electrical steel with high levels of silicon may be produced with outstanding volume resistivity properties without substantial cost penalties.

These objects, features and advantages, as well as others, will be apparent from the teachings of the present invention as hereinafter described in more detail.

DESCRIPTION OF THE PREFERRED EMBODIMENT

Figure 1:
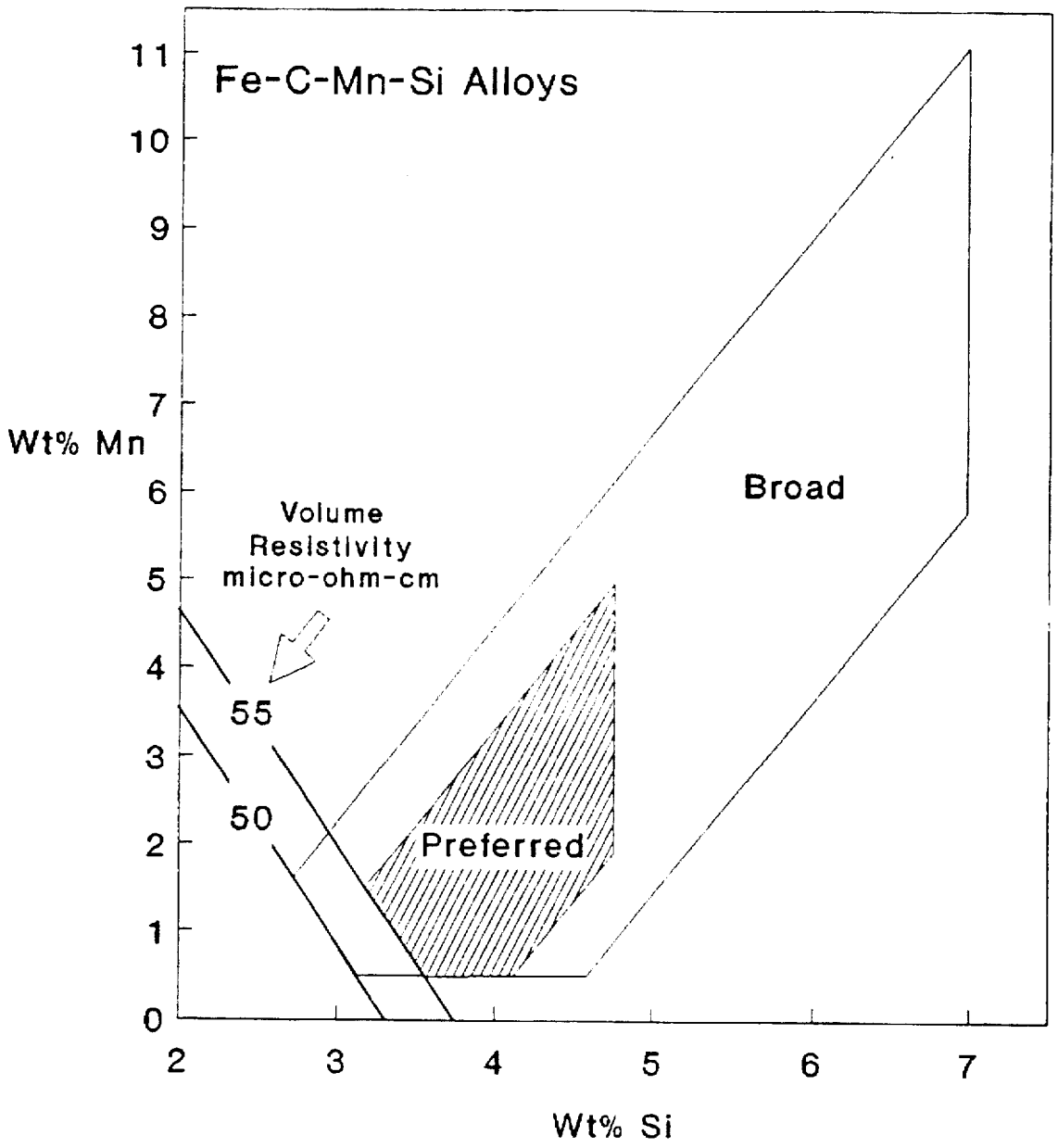
FIG. 1 is a graph illustrating the relationship between the weight % of Mn and Si and the volume resistivity in Fe—C—Mn—Si alloys.
Figure 2:
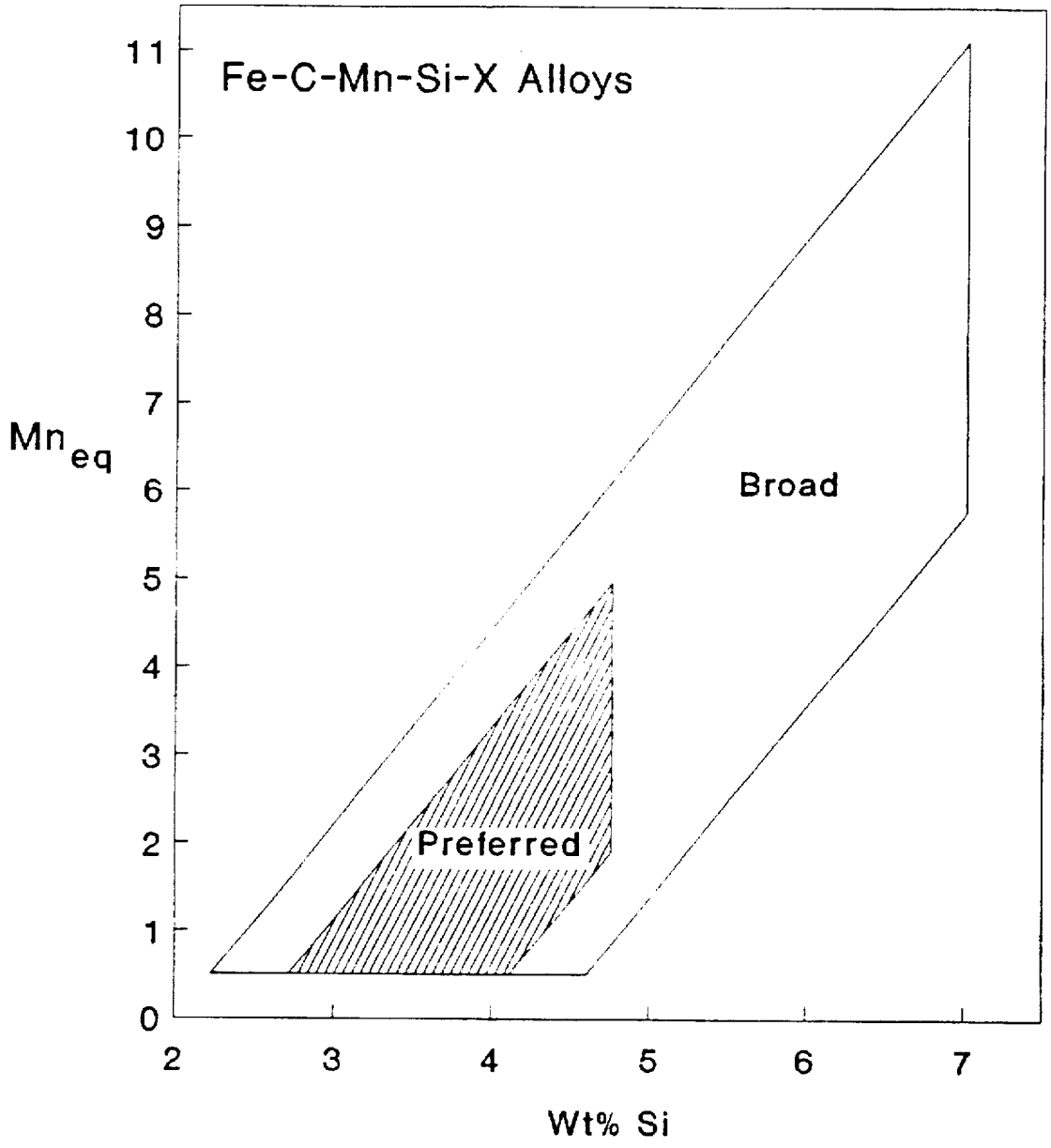
FIG. 2 is a graph illustrating the relationship in weight % between the Mn equivalent ($Mn_{eq}$) and Si and the volume resistivity in Fe—C—Mn—Si—X alloys where X may be one or more of Cr, Cu and Ni.

The present invention provides a high degree of Goss texture in grain oriented electrical steel and allows the use of a low slab reheating temperature. The process includes the use of a nitriding step after decarburizing which provides excess nitrogen at secondary grain growth temperatures. Excess nitrogen is defined by $[(\%N)-0.52(\%Al)]>0$. The steel is substantially fully ferritic prior to the completion of secondary grain growth. The benefits of the present invention are obtained in an alloy having a volume resistivity $\geqq 50$ micro-ohm-cm and preferably $\geqq 55$ micro-ohm-cm. The inventor has found that the volume resistivity of the claimed composition range, in micro-ohm-cm, may be estimated from the weight percent of solute elements by the following relationship:

$$\text{Volume Resistivity}=9.2+12.2\%\ Si+4.6(\%Mn+\%Cr)+2(\%Cu)+\%Ni \quad (1)$$

Optimum core loss properties are provided when the magnetic field in the steel reaches about 89% of saturation, preferably at least 92% of saturation and more preferably at least 95% of saturation in an applied field of 10 oersteds. The % of saturation is estimated by:

$$\%\ \text{Saturation}=B\ (\text{in Teslas at H=10 oersteds})/[\text{Atomic \% Fe}/0.0002115] \quad (2)$$

In those alloys containing nickel, the atomic percent nickel should be added to the atomic percent iron in Equation 2. Equation 2 assumes that the measurements are made on material having an insulating coating.

All chemistry amounts given in the following discussion are in weight %. The levels of silicon, manganese, carbon and other elements must be controlled in order to provide the required amount of austenite during hot rolling and/or the anneal of the cast or hot rolled band preceding the final cold reduction step. The term "hot rolled band" shall include ingots hot rolled to strip, slabs hot rolled to strip and cast strip. The level of austenite should be at least 5% and preferably at least 10%. *In Kawasaki Seitetsu Giho*, vol. 21, no. 3, pp. 93–98, 1989, Sadayori et al. published the following equation to estimate the volume percent of austenite at 1150° C. ($\gamma_{1150°\ C.}$) for Fe—C—Si alloys containing 3.0–3.6% silicon and 0.030–0.065% carbon.

$$\gamma_{1150°\ C.}=694(\%C)-23(\%Si)+64.8 \quad (3)$$

The inventor has found that the expression for $\gamma_{1150°\ C.}$ in Equation (3) is not adequate when manganese and other substitutional solutes are present at the levels claimed for the invention. Regression analysis performed on $\gamma_{1150°\ C}$ data from a family of Fe—C—Si—Mn alloys containing 0.03–0.06% C, 0.1 to 4.0% Mn and 3.0–5.0% Si and supplemental information from Fe—C—3.5Si-0.8Mn—X alloys where X includes one or more of Cr, Ni, and Cu in the range 0.1–0.6% Ni, 0.1–0.6% Cu and 0.1–4.0% Cr, provided a more suitable approximation for $\gamma_{1150°\ C.}$ in the preferred range of Si and $Mn_{eq}$:

$$\gamma_{1150°\ C.}=15.1(\%Mn_{eq})+748(\%C)-33.7(\%Si)+88.7 \quad (4)$$

$$(\%Mn_{eq})=(\%Mn)+1.5(\%Ni)+0.5(\%Cu)+0.1(\%Cr) \quad (5)$$

While silicon, carbon and the constituents of the $Mn_{eq}$ are the primary elements of concern, other elements such as nitrogen, tin, phosphorus, molybdenum, antimony and the like (made as deliberate additions or present as impurities from the steelmaking process) will also affect the amount of austenite and must be considered. For the development of the present invention, the amount of austenite has been found to be critical in order to achieve stable secondary grain growth and the desired (110)[001] orientation. The composition of the band, prior to the final cold reduction, must provide an austenite volume percent measured at 1150° C. (defined as $\gamma_{1150°\ C.}$) in excess of 5% and preferably in excess of 10%, but less than 40%, to achieve the preferred percentage of saturation at H=10 oersteds as defined in Equation (2). It should be understood that the austenite volume percent will decrease at temperatures substantially above or below 1150° C. The austenite volume percent reaches a maximum at a temperature of about 1150° C. and it is convenient to describe an alloy exhibiting transcritical behavior by making a determination of the austenite volume percent at 1150° C.

Grain oriented electrical steels of the invention will have at least 2.25% silicon depending on the levels of $Mn_{eq}$. Silicon is normally greater than 2.725 % and preferably greater than 3.1%. The upper limit of silicon is 7% and preferably about 5%. The silicon content is more preferably about 3.1 to about 4.75%. The silicon level is preferably as high as possible while still permitting good processability. The silicon is balanced with the manganese or its equivalent ($Mn_{eq}$) such that $2.0 \leqq [(\%Si)-0.45(\%Mn_{eq})] \leqq 4.4$. When $(\%Si)-0.45(\%Mn_{eq})$ is below 2.0, the alloy remains transcritical in the absence of carbon and lower secondary grain growth temperatures must be used which normally do not provide the degree of orientation desired. The steels of the invention must be substantially ferritic after decarburization and prior to secondary grain growth. When $(\%Si)-0.45(\%Mn_{eq})$ is above 4.4, the carbon required to get sufficient austenite formation exceeds a level practical for subsequent removal of carbon. The preferred alloy content of the steels are defined using the relationship of:

$$2.5 \leqq |(\%\ Si) - 0.45(\%Mn_{eq})| \leqq 3.9 \quad (6)$$

Silicon is primarily added to improve the core loss by providing higher volume resistivity. Typically, the volume resistivity is increased by about 10–13 micro-ohm-cm for each weight % of silicon. In addition, silicon promotes the formation and/or stabilization of ferrite and, as such, is one of the major elements which affects the volume fraction of austenite. The steels of the invention must be substantially ferritic after decarburization and the amount of austenite ($\gamma_{1150°\ C}$) is controlled to be less than 2%. While higher Si is desired to improve the magnetic quality, its effect on processing must be considered in order to maintain the desired $\gamma_{1150°\ C}$.

Manganese, and the elements included in the expression for manganese equivalents, are used in combination with silicon to provide a base alloy which requires very little carbon to reach the desired $\gamma_{1150°\ C}$ level and to provide the desired volume resistivity. Manganese increases the volume resistivity by 4 to 6 micro-ohm-cm for each weight % of manganese. Manganese may range from less than 0.5% to 11%. It is typically about 0.5 to about 3% with about 3.1 to about 4.75% silicon. The levels of manganese are varied depending on the amount of $Mn_{eq}$ and Si as discussed above. The $Mn_{eq}$ is at least 0.5% and may range up to 11% and still provide the desired composition balance. A preferred upper limit for Mn is 4.5%.

Nickel is included in the expression for $Mn_{eq}$ because it is a powerful austenite stabilizer which is commonly used for alloy additions or found in raw materials used to produce the steels of the invention. The Ni range is restricted to less than 2% to remain within the desired limits of (%Si)–0.45 (%$Mn_{eq}$) for the preferred range of silicon. It is also costly to make intentional Ni additions and Ni is not very effective for increasing volume resistivity.

Copper is included in the expression for $Mn_{eq}$ because it is a moderate austenite stabilizer and is frequently present in the raw materials. The Cu range is restricted to less than 1% because it is a costly addition which can also cause the surface oxide formed during hot rolling and annealing to become more difficult to remove. Cu is not very effective for increasing volume resistivity.

Chromium is included in the expression for $Mn_{eq}$ because it is a powerful agent for increasing volume resistivity, has a small affect on the austenite volume fraction at 1150° C., and is a commonly used alloy addition which might be found in raw materials used to produce the invention. Chromium may be successfully added in amounts up to 3% and preferably up to 2%. Additions greater than 0.5% cause a significant increase in the volume resistivity even in alloys where the %$Mn_{eq}$ is less than 0.5% as long as the % Si–0.45%$Mn_{eq}$ remains in the claimed range. The Cr range is restricted to less than 3% because decarburization becomes difficult above this level, particularly in alloys containing >3.5% Si.

Typically, carbon and/or additions such as copper, nickel and the like which promote and/or stabilize austenite, are employed to maintain the desired $\gamma Y_{1150°\ C}$ during processing. The amount of carbon present in the melt is at least 0.01% and preferably at least about 0.025%. When the carbon is less than 0.025%, secondary molten metal refining may be required and production cost is increased. Carbon contents above 0.080% require excessive decarburizing anneal times and lowers productivity. Preferably, the carbon content is from about 0.025–0.050%.

Nitrogen present in the melt composition should be controlled to a level chosen between 0.001 and 0.011%. Nitrogen influences AlN formation, $\gamma_{1150°\ C}$, and the physical quality of the strip produced. Below 0.002% nitrogen, the control of the nitrogen content becomes too difficult and above 0.011% nitrogen, the chance of physical defects in the strip increases to an unacceptable level. After decarburization, the amount of nitrogen will be increased due to the nitriding treatment. Typically, the nitrogen added will be about 0.01–0.02%.

Acid soluble aluminum should be at least 0.015% and preferably above 0.020% to allow sufficient levels of AlN to form. When the acid soluble Al level exceeds 0.050% secondary grain growth may become difficult to control. A preferred range of acid soluble aluminum is 0.02 to 0.04%.

Sulfur and selenium are each restricted to levels less than 0.01% and preferably less than 0.005% to reduce or eliminate the time required for their removal in the final high temperature purification anneal.

The steel may also include other elements such as antimony, arsenic, bismuth, molybdenum, phosphorus, tin and the like made as deliberate additions or as impurities from steelmaking process which can affect the austenite volume fraction and/or the stability of the secondary grain growth.

A melt having a composition of the invention may be cast directly to a strip thickness suitable for cold rolling, hot rolled from a cast slab using the retained heat from the casting process or hot rolled from a cast slab or a slab rolled from an ingot by heating to a temperature in the range 1000° to 1400° C. prior to hot rolling. Excellent magnetic properties may be obtained when cast slabs are hot rolled from temperatures below 1300° C. and preferably below 1250° C.

An anneal of the strip prior to the final cold reduction is typically conducted to improve final product properties and their uniformity when the grain oriented electrical steel band is produced by hot rolling. The anneal(s) is performed on a band prior to cold rolling or on strip following one or more cold reductions. An anneal is normally conducted at 900°–1150° C. (1650°–2100° F.) and preferably at 980°–1125° C. (1800°–2050° F.) for a time of up to 10 minutes (preferably less than 2 minutes). The strip is then cooled in a controlled manner to provide a microstructure suitable for the final cold reduction step.

After cold reduction to final thickness is completed, conventional strip decarburization is required to reduce the C level to an amount which avoids magnetic aging (less than 0.005% C and typically less than 0.003%). In addition, the decarburization anneal prepares the steel for the formation of a forsterite, or "mill glass", coating in the high temperature final anneal by reaction of the surface oxide skin and the annealing separator coating. It was determined that ultra-rapid annealing as part of the decarburizing process, as taught in U.S. Pat. No. 4,898,626, may be used to increase productivity, and improve magnetic quality.

The steels of the present invention are typically processed from solidification through primary recrystallization in the decarburizing treatment with excess aluminum. The amount of excess aluminum is defined by the relationship of $|(\%N) - 0.52(\%Al)| < 0$ and typically $< -0.005$ weight %. However, the steels of the present invention should contain excess nitrogen prior to the start of secondary growth, that is $|(\%N) - 0.52(\%Al)| > 0$ and preferably $> 0.004$ weight %. The typical steel of the invention then must be nitrided between the stages of primary recrystallization and before the completion of secondary grain growth. The nitriding may be accomplished using any process or combination of processes, such as by plasma nitriding, ion nitriding, salt bath nitriding, nitrogen bearing compounds in the annealing separator or by nitrogen, nitrogen bearing compounds and/or ammonia in the annealing atmosphere. The base metal has from 0.001 to 0.011% nitrogen prior to the nitriding process. The nitriding process typically will add at least about 50 ppm (0.005%) of nitrogen into the strip which raises the excess nitrogen preferably to an amount of at least about 0.004%. Typically, the nitriding will add at least 70 ppm (0.007%) nitrogen. The nitriding may be accomplished in flat or coiled form. Typically, a continuous strip nitriding treatment would use an atmosphere containing hydrogen, nitrogen and ammonia. The continuous strip nitriding step would follow the decarburizing step in a tandem operation and be conducted at a temperature of about 750°–900° C. If the majority of the nitriding is done in a coiled strip anneal by the use of a nitrogen containing atmosphere and/or a nitrogen bearing additive to the annealing separator, the atmosphere should contain at least 10% nitrogen by volume when heating in the temperature range of 700° C. to the temperature where secondary grain growth is essentially complete.

The final high temperature anneal is needed to develop the (110)[001] grain orientation or "Goss" texture. Typically, the steel is heated to a soak temperature of at least about 1100° C. (2010° F.) in an atmosphere containing hydrogen and 5% to 75% nitrogen. Typical annealing conditions used in the practice of the present invention employed heating rates of 10° to 50° C. (18° to 90° F.) per hour up to about 815° C. (1500° F.) and subsequent heating rates of about 50° C. (90° F.) per hour, and, preferably, 25° C. (45° F.) per hour or lower up to the completion of secondary grain growth at about 1050° C. (1920° F.). Once secondary grain growth is complete, the heating rate is not as critical and may be increased until the desired soak temperature is attained wherein the material is held for a time of at least 5 hours (preferably at least 15 hours), in essentially pure hydrogen, for removal of the nitrogen and other impurities, especially sulfur, as is well known in the art.

A cube texture material having a (100)[001] or (100)[hkl] orientation may also be produced with the invention by methods known to the art. For example, a (110)[001] grain oriented material produced by the method above may be further processed by the method disclosed in U.S. Pat. No. 3,130,092. A cast or hot rolled sheet having a composition in the range of this invention may also be used to produce a cube texture material by the cross rolling method originally taught in U.S. Pat. No. 3,130,093 and more recently adapted for one low reheat technology in U.S. Pat. No. 5,346,559.

EXAMPLE 1

A series of heats were melted and processed in the laboratory to illustrate the beneficial effect of higher volume resistivity on reducing core loss. The melt compositions of the heats are shown in Table 1.

TABLE 1

| | Heat Chemistry (Weight %) | | | | | | | | | |
|---|---|---|---|---|---|---|---|---|---|---|
| ID | % C | % Mn | % S | % Si | % Cr | Al (sol) | N | Ni | Cu | Mo |
| A | 0.043 | 0.10 | 0.002 | 3.24 | 0.11 | 0.029 | .0082 | 0.09 | 0.16 | 0.032 |
| B* | 0.044 | 1.05 | 0.003 | 3.56 | 0.12 | 0.029 | .0074 | 0.08 | 0.17 | 0.036 |

* = Steels of the invention
Heats also had 0.01% Sn and 0.02% P

The alloys were vacuum melted and cast into 100 mm wide, 25 mm thick ingots and allowed to cool to room temperature. The ingots from composition A and B were hot rolled after heating for 1 hour in a furnace set at 1200° and 1260° C. respectively. The ingots were removed from the furnace and hot rolled to 10 mm in 2 passes on a reversing hot mill within 20–23 seconds. The 10 mm strip was then air cooled to 950°–960° C. and finish rolled on the same reversing hot mill to 2.5 mm in 3 additional passes within 43 seconds of reaching 960° C. A finishing temperature of 815°–845° C. was achieved on both ingots by rolling directly into and from a heat retention furnace before the final reduction. After rolling, the strips were water spray cooled to room temperature within 20 seconds. The hot rolled sheets were annealed in a furnace at a temperature of 1095° C. (2000° F.) for 3 minutes, air cooled to 870° C. (1600° F.) and quenched in boiling water. The surface oxides were removed and the annealed sheets were cold rolled to a thickness of 0.28 mm (0.011 inches). The cold rolled sheets were decarburized in a humidified hydrogen-nitrogen atmosphere with a peak temperature of 880° C. The $PH_2O/PH_2$ used for compositions A and B were 0.40 and 0.20 respectfully. The samples were coated with a separator coating containing primarily MgO and box annealed. The separator coating used contained electrical steel grade MgO with an addition of 8 weight % $Mn_4N$. The box annealing was conducted using an atmosphere of 75% $H_2$–25% $N_2$ up to 1205° C. and then held for 24 hours in pure $H_2$ at 1205° C. The heating rates used were 167° C./hour to 590° C.;28° C./hour from 590° to 1010° C.;4° C./hour from 1010° to 1090° C.; and 28° C./hour from 1090° to 1200° C. Following the box anneal, the samples had the unreacted magnesia removed and were stress relief annealed at 780° C. for 1 hour in 95% nitrogen–5% hydrogen. The magnetic properties after stress relief annealing are reported in Table 2.

TABLE 2

| | Magnetic Quality | | | |
|---|---|---|---|---|
| ID | Volume Resistivity μ-Ω-cm | 1.5T W/kg | 1.7T W/kg | B8 Perm |
| A | 49 | 0.99 | 1.30 | 1931 |
| B* | 58 | 0.84 | 1.15 | 1894 |

*= Steels of the invention

The permeabilities were measured at 796 A/m and the core losses were measured at 1.5 and 1.7 Teslas at 60 Hertz. It is seen that when the $Mn_{eq}$ is too low as in Heat A (0.325), the volume resistivity does not meet the minimum level required (50 μ-Ω-cm). Heat B with a $Mn_{eq}$ of about 1.27 had excellent volume resistivity (58 μ-Ω-cm).

EXAMPLE 2

In addition to Heats A and B in Example 1, a further series of heats were melted and processed to thicknesses of 0.26 and 0.30 mm. The melt compositions of the additional heats are shown in Table 3 as G-T. Identification codes C-F represent nominal compositions of commercial materials processed using a reheat temperature above 1300° C. Materials C and D were reduced more than 80% in the last cold reduction and materials E and F were reduced less than 80% in the last cold reduction. Furthermore, materials C and E represent good magnetic quality whereas materials D and F represent poor magnetic quality for the production method used. All of the C-F heats had a $Mn_{eq}$ less than 0.5% and heats E and F had less than 0.01% acid soluble aluminum.

Heats G-T were vacuum melted and cast into 25×100 mm ingots. The material was processed by hot rolling from a reheat temperature of 1150° –1175° C. using the reduction and cooling practice outlined in Example 1. The hot rolled strips were annealed by the method in Example 1. The strip was cold rolled to a thickness of 0.26 or 0.30 mm prior to decarburizing in a humidified hydrogen-nitrogen atmosphere. The decarbuization anneal consisted of heating to a temperature in the range of 815°–860° C. in about 60 seconds and then holding at this temperature range for 60–120 seconds. The $PH_2O/PH_2$ was held in the range of 0.15–0.25. All samples were box annealed using a separator coating consisting primarily of electrical steel grade MgO. A nitrogen bearing compound was not used in the separator coating. With the exception of Sample G, all nitriding was done in the box anneal by heating in a 3:1 (hydrogen:nitrogen) atmosphere at a heating rate of 28° C./hour. Sample G was strip nitrided to a nitrogen level between 0.015 and 0.02 in an operation performed after decarburization but prior to MgO coating. The strip nitriding conditions were 120 seconds above 650° C. with 20–30 seconds at or about 760° C. in a 3:1 hydrogen-nitrogen atmosphere containing 4000 ppm $NH_3$ and 7500 ppm $H_2O$.

Table 4 shows that the steels of the present invention may be reheated to the lower slab reheat temperatures and still provide a high percentage of saturation at 796 A/m. Heats G and P did not have the minimum $Mn_{eq}$ of the invention (>0.5%).

Steels U-X represent examples from U.S. Pat. No. 5,250,123. All of these examples had aluminum below the minimum level of the present invention (0.015%), had carbon below the minimum level of the present invention (0.01%) and required that the (% Si)–0.45($Mn_{eq}$) be less than 2.0.

TABLE 3

Heat Chemistry (Weight %)

| ID | % C | % Mn | % S | % Si | % Cr | % Al (sol) | % N | % Ni | % Cu | % Mo | % $Mn_{eq}$ | % Si – 0.45 × $Mn_{eq}$ |
|---|---|---|---|---|---|---|---|---|---|---|---|---|
| C | 0.07 | 0.075 | 0.025 | 3.25 | 0.10 | 0.03 | 0.008 | 0.10 | 0.15 | 0.035 | 0.31 | 3.11 |
| D | 0.05 | 0.075 | 0.025 | 2.90 | 0.00 | 0.03 | 0.008 | 0.01 | 0.01 | 0.010 | 0.10 | 2.86 |
| E | 0.03 | 0.059 | 0.021 | 3.45 | 0.07 | <.002 | <.005 | 0.07 | 0.09 | 0.02 | 0.22 | 3.35 |
| F | 0.03 | 0.059 | 0.021 | 3.15 | 0.07 | <.005 | <.010 | 0.07 | 0.09 | 0.02 | 0.22 | 3.05 |
| G | 0.05 | 0.10 | 0.007 | 3.28 | 0.01 | 0.03 | 0.008 | 0.01 | 0.01 | 0.001 | 0.12 | 3.23 |
| H* | 0.04 | 3.07 | 0.003 | 4.68 | 0.08 | 0.03 | 0.007 | 0.10 | 0.16 | 0.036 | 3.31 | 3.19 |
| I* | 0.06 | 1.58 | 0.003 | 4.09 | 0.09 | 0.03 | 0.007 | 0.10 | 0.16 | 0.032 | 1.82 | 3.27 |
| J* | 0.04 | 1.61 | 0.004 | 3.48 | 0.10 | 0.03 | 0.009 | 0.10 | 0.15 | 0.001 | 1.85 | 2.65 |
| K* | 0.04 | 0.73 | 0.003 | 3.63 | 0.10 | 0.03 | 0.009 | 0.10 | 0.16 | 0.035 | 0.97 | 3.19 |
| L* | 0.05 | 0.80 | 0.007 | 3.72 | 0.01 | 0.03 | 0.007 | 0.01 | 0.01 | 0.001 | 0.82 | 3.35 |
| M* | 0.04 | 0.73 | 0.004 | 3.72 | 0.10 | 0.02 | 0.009 | 0.10 | 0.17 | 0.041 | 0.98 | 3.28 |
| N* | 0.04 | 0.80 | 0.003 | 3.48 | 0.51 | 0.03 | 0.008 | 0.56 | 0.16 | 0.039 | 1.77 | 2.68 |
| O* | 0.04 | 0.80 | 0.003 | 3.50 | 0.54 | 0.03 | 0.009 | 0.10 | 0.69 | 0.039 | 1.35 | 2.89 |
| P | 0.04 | 0.10 | 0.002 | 3.20 | 0.10 | 0.03 | 0.008 | 0.10 | 0.15 | 0.035 | 0.34 | 3.05 |
| Q* | 0.04 | 0.81 | 0.004 | 3.09 | 0.10 | 0.03 | 0.008 | 0.10 | 0.15 | 0.001 | 1.05 | 2.62 |
| R* | 0.04 | 0.78 | 0.004 | 3.51 | 0.10 | 0.03 | 0.009 | 0.10 | 0.15 | 0.001 | 1.02 | 3.05 |
| S* | 0.04 | 1.00 | 0.003 | 3.60 | 0.10 | 0.03 | 0.007 | 0.10 | 0.15 | 0.035 | 1.24 | 3.04 |
| T* | 0.03 | 2.00 | 0.003 | 3.90 | 0.10 | 0.03 | 0.007 | 0.10 | 0.15 | 0.035 | 2.24 | 2.89 |
| U+ | 0.003 | 1.53 | 0.002 | 2.35 | — | 0.01 | 0.004 | — | — | — | 1.55 | 1.65 |
| V+ | 0.003 | 1.40 | 0.003 | 2.10 | — | 0.01 | 0.004 | — | — | — | 1.42 | 1.46 |
| W+ | 0.005 | 1.85 | 0.001 | 2.62 | — | 0.01 | 0.004 | — | — | — | 1.87 | 1.78 |
| X+ | 0.004 | 2.66 | — | 2.72 | — | 0.01 | 0.005 | — | — | — | 2.68 | 1.51 |

* = Steels of the invention
+ = Steels of U.S. 5,250,123

TABLE 4

Magnetic Quality

| ID | Measured μ-Ω-cm | Estimated μ-Ω-cm | Permeability @ 796A/m | Estimated Percent of Saturation. @ 796A/m | Nominal Thickness mm |
|---|---|---|---|---|---|
| C | 49.8 | 50.4 | 1920 | 97.3 | 0.26 |
| D | 45.0 | 45.0 | 1880 | 94.3 | 0.35 |
| E | | 52.2 | 1845 | 93.7 | 0.26 |
| F | 48.0 | 48.6 | 1780 | 89.8 | 0.35 |
| G | | 49.8 | 1918 | 97.0 | 0.26 |
| H* | | 81.3 | 1655 | 89.1 | 0.26 |
| I* | 66.7 | 67.3 | 1699 | 88.9 | 0.26 |
| J* | 60.4 | 60.0 | 1711 | 88.5 | 0.26 |
| K* | 58.7 | 57.8 | 1882 | 96.7 | 0.26 |
| L* | | 58.3 | 1885 | 96.9 | 0.26 |
| M* | 59.4 | 58.9 | 1815 | 93.5 | 0.26 |
| N* | 58.7 | 58.7 | 1775 | 91.4 | 0.26 |
| O* | 60.0 | 59.7 | 1781 | 92.3 | 0.26 |
| P | 50.3 | 49.7 | 1931 | 96.3 | 0.30 |
| Q | 50.9 | 50.8 | 1880 | 93.6 | 0.30 |
| R* | 55.9 | 56.5 | 1875 | 94.2 | 0.30 |
| S* | 58.4 | 58.7 | 1894 | 95.6 | 0.30 |
| T* | 67.2 | 67.0 | 1771 | 90.9 | 0.30 |
| U+ | | 45.0 | 1870 | 92.3 | 0.30 |
| V+ | | 41.3 | 1850 | 90.7 | 0.35 |
| W+ | | 49.8 | 1860 | 92.6 | 0.26 |
| X+ | | 54.7 | 1800 | 90.6 | 0.30 |

*= Steels of the invention
+= Steels of U.S. 5,250,123
The permeabilities were measured at 796 A/m.

EXAMPLE 3

A 160 ton heat was processed to evaluate the mechanical properties for the present invention and evaluate the processing characteristics. The heat (Y) was melted in an electric arc furnace, desulfurized in a ladle and vacuum degassed. The heat was continuously cast into 200 mm thick slabs having the composition shown in Table 5. The steel composition also included 0.005% Ti, 0.01% Sn, 0.005% P and balance essentially iron. The composition had a measured volume resistivity of 61.4 micro-ohm-cm. Four of the slabs were reheated to 1160° C. (2120° F.) and four of the slabs were reheated to 1254° C. (2290° F.) prior to hot rolling to 2.3 mm (0.090 inch). The coils of hot rolled strip were then welded and edge slit at temperatures ranging from 60 to 200° C. to evaluate the processability of the material. Sound welds were produced and there were no coil separations or edge cracks.

Hot rolled strip samples were annealed in the laboratory for 180 seconds in a furnace heated to about 1065° C., air cooled to 590°–600° C. and quenched in boiling water. The samples had the oxide removed and were cold rolled to a thickness of 0.26mm. The cold rolled strip was decarburized for 120 seconds in a humidified hydrogen-nitrogen atmosphere with $PH_2O/PH_2$=0.25. The strip was induction heated at 400°–450° C./second to a temperature of 730°–750° C. and then heated to a peak temperature of 860° C. in about 100 seconds. The decarburized strip had a separator coating applied which consisted mainly of MgO and was heated in a 3:1 hydrogen-nitrogen atmosphere at 15° C./hour to a temperature of 1200° C. and held at 1200° C. for 24 hours in dry hydrogen. Samples from both slab heating temperatures reached 91 to 95% of saturation in an applied field of 796 A/m.

TABLE 5

| Heat Chemistry (Weight %) | | | | | | | | | | |
|---|---|---|---|---|---|---|---|---|---|---|
| ID | % C | % Mn | % S | % Si | % Cr | Al (sol) | N | Ni | Cu | Mo |
| Y | 0.046 | 1.27 | 0.005 | 3.72 | 0.10 | 0.030 | .007 | 0.10 | 0.15 | 0.03 |

EXAMPLE 4

One hot rolled strip sample from each slab heating condition in Example 3 was annealed in the laboratory for 180 seconds in a furnace heated to 1010° C., air cooled to 590°–600° C. and quenched in boiling water. The samples had the oxide removed and were cold rolled to a thickness of 0.28 mm. The cold rolled strip was decarburized for a total of 240 seconds by heating to 830° C. in 60 seconds then heated to a peak temperature of 860° C. at about 0.2° C./second in a humidified hydrogen-nitrogen atmosphere with $PH_2O/PH_2$=0.30. The decarburized strip had a separator coating applied which consisted entirely of electrical steel grade MgO and was heated 3:1 hydrogen-nitrogen atmosphere at 15° C./hr to a temperature of 1200° C. and held at 1200° C. for 24 hours in dry hydrogen. The magnetic properties are listed in Table 6.

TABLE 6

| Magnetic Test Result | | | |
|---|---|---|---|
| Slab Heating Temperature °C. | Peak Permeability @ 796 A/m | Measured % of Saturation @ 796 A/m | Calculated % of Saturation @ 796 A/m |
| 1160 | 1842 | 95.3 | 95.4 |
| 1254 | 1790 | 92.6 | 92.8 |

EXAMPLE 5

A series of heats were melted and processed in the laboratory to illustrate the effect of chromium additions. The ingot composition of six compositions are shown in Table 7.

TABLE 7

| Heat Chemistry (Weight %) | | | | | | | | | | | | |
|---|---|---|---|---|---|---|---|---|---|---|---|---|
| ID | C | Mn | P | S | Si | Cr | Ni | Cu | Mo | Sn | Al (sol) | N |
| AA | .039 | .11 | .021 | .002 | 3.25 | 1.00 | 0.11 | 0.16 | .035 | .013 | .024 | .007 |
| AB | .040 | .11 | .020 | .003 | 3.18 | 1.98 | 0.11 | 0.16 | .034 | .013 | .024 | .008 |
| AC | .049 | .81 | .022 | .002 | 3.69 | 0.27 | 0.11 | 0.16 | .035 | .013 | .027 | .008 |
| AD | .050 | .81 | .022 | .003 | 3.76 | 0.95 | 0.11 | 0.16 | .034 | .013 | .026 | .008 |
| AE | .054 | .80 | .014 | .002 | 3.72 | <.01 | <.01 | <.01 | .001 | .001 | .024 | .007 |
| AF | .054 | .80 | .014 | .002 | 3.68 | 0.80 | <.01 | <.01 | .001 | .001 | .022 | .007 |

The alloys were vacuum melted and cast into 100 mm wide, 25 mm thick ingots and allowed to cool to room temperature. The ingots were reheated to a temperature of 1150° C. and hot rolled to a thickness of 2.5 mm. The hot rolled sheets were annealed in a furnace heated to a temperature of 1093° C. for three minutes, air cooled to 870° C. and quenched in boiling water. The surface oxides were removed and the annealed sheets were cold rolled to a thickness of 0.28 mm. The cold rolled strip for all alloys except AB was decarburized for a total of 240 seconds by heating to 830° C. in 60 seconds then less rapidly to a peak temperature of 860° C. in a humidified hydrogen-nitrogen atmosphere with $PH_2O/PH_2$=0.30. Alloy AB was decarburized in the same manner except that the time of the anneal was extended to 300 seconds. The decarburized strip had a separator coating applied which consisted entirely of electrical steel grade MgO and was heated in a 3:1 hydrogen-nitrogen atmosphere at 15° C./hr to a temperature of 1200° C. and held at 1200° C. for 24 hours in dry hydrogen. The magnetic properties are listed in Table 8.

TABLE 8

Magnetic Test Results

| ID | % $Mn_{eq}$ | % Si - .45 % $Mn_{eq}$ | Volume Resistivity μ-Ω-cm | Peak Permeability @ 796 A/m | Calculated % Saturation @ 796 A/m |
|---|---|---|---|---|---|
| AA | 0.46 | 3.05 | 54.7 | 1812 | 92.8 |
| AB | 0.55 | 2.93 | 58.3 | 1830 | 94.6 |
| AC | 1.08 | 3.20 | 59.9 | 1758 | 90.7 |
| AD | 1.15 | 3.24 | 63.9 | 1810 | 94.3 |
| AE | 0.81 | 3.36 | 58.6 | 1832 | 94.1 |
| AF | 0.89 | 3.28 | 61.8 | 1808 | 93.6 |

The preferred embodiment discussed hereinabove has demonstrated that a grain oriented electrical steel having a volume resistivity of at least 50 micro-ohm-cm in combination with the other processing steps of the present invention does provide a consistent and excellent level of magnetic quality which compares favorably with the conventional two stage cold reduction processes of the prior art. The present invention may also employ a starting band which has been produced using methods such as thin slab casting, strip casting or other methods of compact strip production.

The invention as described hereinabove in the context of a preferred embodiment is not to be taken as limited to all of the provided details thereof, since modifications and variations thereof may be made without departing from the spirit and scope of the invention.

What is claimed is:

1. A grain oriented electrical steel melt, consisting essentially of, in weight %, 2.25–7% Si, 0.01–0.08% C, 0.015–0.05% Al, up to 0.01% S, 0.001–0.011% N, $Mn_{eq}$ of at least 0.5% and balance being essentially iron and normally occurring residual elements to provide a volume resistivity in a cold reduced grain oriented electrical steel of at least 50 micro-ohm-cm, said steel melt balanced such that $2.0 \leqq \{(\%Si)-0.45(\%Mn_{eq})\} \leqq 4.4$ wherein $\%Mn_{eq}$ is defined as $(\%Mn)+1.5(\%Ni)+0.5(\%Cu)+0.1(\%Cr)$.

2. The steel of claim 1 wherein $2.5 \leqq \{(\%Si)-0.45(\%Mn_{eq})\} \leqq 3.9$.

3. The steel of claim 1 wherein said silicon is 2.725–5%, said manganese is about 0.5–3%, said aluminum is 0.02–0.04% and said carbon is at least 0.025%.

4. The steel of claim 1 wherein said Si is 3.1–4.75% and said carbon is 0.025–0.05%.

5. A cold reduced grain oriented electrical steel coated with an annealing separator coating, said steel produced from a hot rolled band containing 0.01–0.08% C, said steel consisting essentially of, in weight %, 2.25–7% Si, less than 0.005% C, 0.015–0.05% Al, up to 0.01% S, at least 0.004% excess N, $Mn_{eq}$ of at least 0.5% and balance being essentially iron and normally occurring residual elements to provide a volume resistivity of at least 50 micro-ohm-cm, said steel balanced such that $2.0 \leqq \{(\%Si)-0.45(\%Mn_{eq})\} \leqq 4.4$ wherein $\%Mn_{eq}$ is defined as $(\%Mn)+1.5(\%Ni)+0.5(\%Cu)+0.1(\%Cr)$.

6. A cold reduced grain oriented electrical steel coated with an annealing separator coating, said steel produced from a hot rolled band containing 0.01–0.08% C and at least 5% austenite at a temperature of 1150° C. said steel consisting essentially of, in weight %, 2.25–7% Si, less than 0.005% C, 0.015–0.05% Al, up to 0.01% S, at least 0.015% N, $Mn_{eq}$ of at least 0.5% and balance being essentially iron and normally occurring residual elements to provide a volume resistivity of at least 50 micro-ohm-cm, said steel balanced such that $2.0 \leqq \{(\%Si)-0.45(\%Mn_{eq})\} \leqq 4.4$ wherein $\%Mn_{eq}$ is defined as $(\%Mn)+1.5(\%Ni)+0.5(\%Cu)+0.1(\%Cr)$.

7. A cold reduced grain oriented electrical steel coated with an annealing separator coating, said steel consisting essentially of, in weight %, 2.25–7% Si, less than 0.005% C, 0.015–0.05% Al, excess N uncombined with Al, up to 0.01% S, $Mn_{eq}$ of at least 0.5% and balance being essentially iron and normally occurring residual elements to provide a volume resistivity of at least 50 micro-ohm-cm, said steel balanced such that $2.0 \leqq \{(\%Si)-0.45(\%Mn_{eq})\} \leqq 4.4$ wherein $\%Mn_{eq}$ is defined as $(\%Mn)+1.5(\%Ni)+0.5(\%Cu)+0.1(\%Cr)$.

8. A cold reduced grain oriented electrical steel coated with an annealing separator coating, said steel consisting essentially of, in weight %, 2.25–7% Si, less than 0.005% C, 0.015–0.05% Al, at least 0.015% N, up to 0.01% S, $Mn_{eq}$ of at least 0.5% and balance being essentially iron and normally occurring residual elements to provide a volume resistivity of at least 50 micro-ohm-cm, said steel balanced such that $2.0 \leqq \{(\%Si)-0.45(\%Mn_{eq})\} \leqq 4.4$ wherein $\%Mn_{eq}$ is defined as $(\%Mn)+1.5(\%Ni)+0.5(\%Cu)+0.1(\%Cr)$.

* * * * *